United States Patent [19]

Ayres et al.

[11] Patent Number: 4,907,327

[45] Date of Patent: Mar. 13, 1990

[54] DEVICE FOR AUTOMATICALLY SECURING A BORDERWIRE ON A MATTRESS INNERSPRING

[76] Inventors: Donald B. Ayres, 4708-C Main St., Skokie, Ill. 60076; Mark A. Forsthoff, 1221 West Clarendon Rd., Arlington Heights, Ill. 60004

[21] Appl. No.: 360,127

[22] Filed: Jun. 1, 1989

[51] Int. Cl.[4] ..... B68G 7/00

[52] U.S. Cl. ..... 29/91; 29/173; 29/709; 29/712; 29/715; 200/61.41; 140/93 D

[58] Field of Search ..... 29/91, 173, 622, 709, 29/712, 714, 715; 200/61.41; 140/93 D

[56] References Cited

U.S. PATENT DOCUMENTS 3,573,406 4/1971 Neuhoff ..... 200/61.41
3,697,710 10/1972 Jarrett ..... 200/61.41
4,461,936 7/1984 Kimura et al. ..... 200/61.41
4,724,590 2/1988 Langas et al. ..... 29/91
4,829,643 5/1989 Ayres et al. ..... 29/91

*Primary Examiner*—P. W. Echols
*Attorney, Agent, or Firm*—Wallenstein, Wagner & Hattis, Ltd.

[57] ABSTRACT

A device for automatically securing a borderwire on a mattress innerspring comprising a plurality of coils is disclosed. The device comprises a tool for sequentially joining segments of the borderwire to perimeter ones of the coils located along a perimeter of the innerspring, apparatus for advancing the mattress innerspring and borderwire toward the tool, a conductive element for sequentially contacting the perimeter ones of the coils, a sensor for detecting contact of the conductive element with the perimeter ones of the coils, and a control responsive to the sensor for actuating the tool.

8 Claims, 3 Drawing Sheets

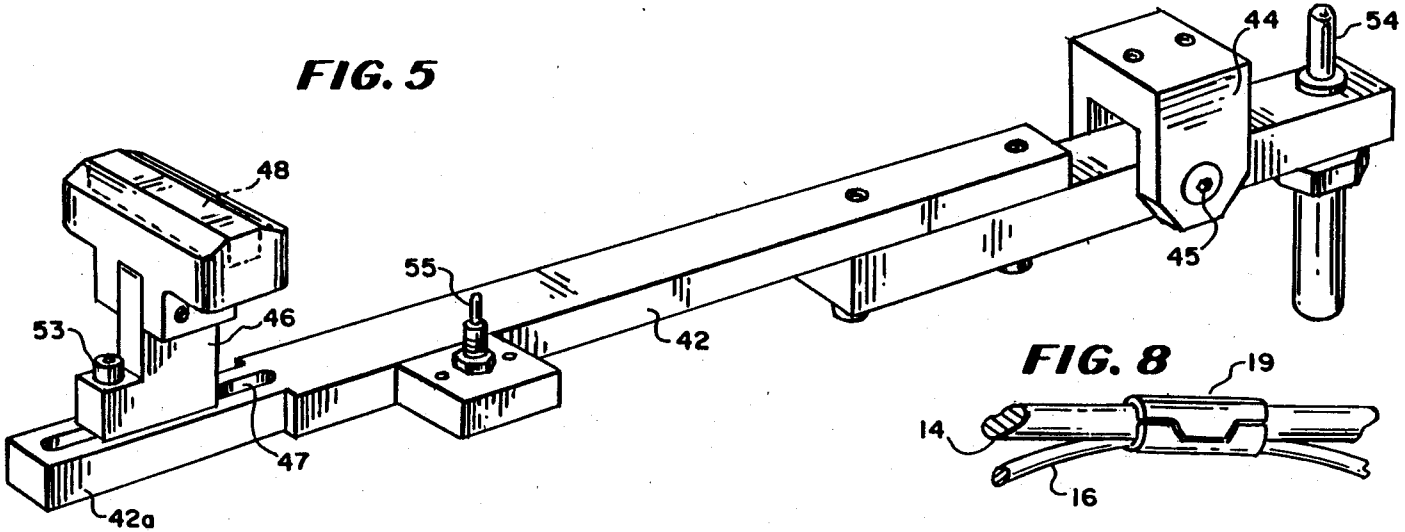
FIG. 5
FIG. 8
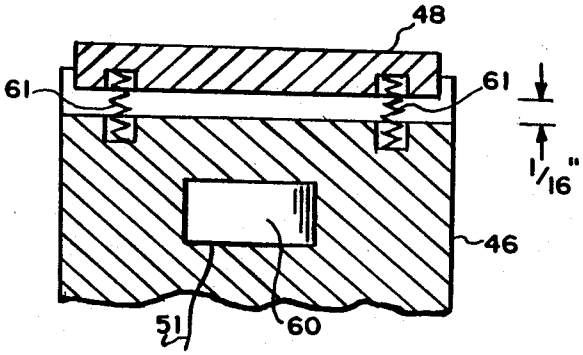
FIG. 7
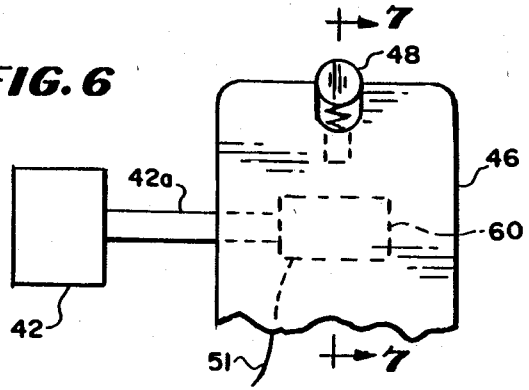
FIG. 6

DEVICE FOR AUTOMATICALLY SECURING A BORDERWIRE ON A MATTRESS INNERSPRING

TECHNICAL FIELD

The invention relates to an improved device for automatically securing a borderwire on a mattress innerspring coil, and more particularly, to a sensor for the device for determining the position of the mattress innerspring coil relative to the device.

BACKGROUND PRIOR ART

A mattress innerspring comprises a plurality of coil springs including a plurality of perimeter coils defining the perimeter of the innerspring.

A mattress assembly comprises the mattress innerspring sandwiched between a pair of borderwires. The mattress innerspring is secured to the borderwires by means of clips wrapped around a portion of each of the perimeter coils and associated portions of the borderwires.

Apparatuses for securing borderwires on a mattress innerspring are known in the art.

One such apparatus is disclosed in commonly assigned U.S. Pat. No. 4,829,643 entitled "Apparatus and Method For Automatically Securing Borderwires On Mattress Innerspring", to Ayres, et al.

According to Ayres, et al, the mattress assembly is advanced along a horizontal ledge to a clip wrapping station, comprising a pair of spaced clip wrapping tools. As the mattress assembly is advanced along the ledge, sequential alignment of each of the perimeter coils with the clip-wrapping tools is detected by a fiber optic sensor. Upon alignment detection, advancement of the mattress innerspring and borderwires is momentarily stopped, and the clip wrapping tools apply the clips on the borderwires and innerspring, thereby securing them together.

The fiber optic sensing system has proven effective in many applications. However, because the unclipped mattress innerspring and borderwires are not in perfect and consistent alignment, occasional clips were missed, which would have to be manually added later. In addition, the fiber optics had to be readjusted when switching to a mattress innerspring having different size coils. Further, fiber optic devices are inherently susceptible to environmental problems such as dirt accumulation.

Others have utilized computer indexing to determine the position of the innerspring relative to the clip wrapping tool. However, such devices also have problems because of the imperfect alignment of the innerspring coils. In addition, computer indexing adds an undesirable additional level of complexity to the device.

The present invention is provided to solve these and other problems.

SUMMARY OF THE INVENTION

It is an object of this invention to provide a device for automatically securing a borderwire on a mattress innerspring comprising a plurality of coils.

The device includes a tool for joining segments of the borderwire to perimeter ones of the coils located along a perimeter of the innerspring, and means for advancing the mattress innerspring and borderwire toward the tool. The device further includes an element for sequentially contacting the perimeter coils, a sensor for detecting contact of the element with the perimeter coils, and means responsive to the sensor for actuating the tool.

According to one embodiment of the invention, the element is conductive and maintained at a first voltage potential, the perimeter coils are maintained at a second, different voltage potential, and the sensor includes means for detecting current passing between the conductive element and the perimeter ones of the coils.

It is comprehended that the first voltage potential is less than 24 volts, preferably of the order of twelve volts, and the second voltage potential is substantially ground.

According to another embodiment of the invention, the sensor includes a proximity switch and means for biasing the element away from the proximity switch. Sequential contact of each of the perimeter ones of the coils with the element opposes the biasing means, moving the element toward the proximity switch for detection.

Other features and advantages of the invention will be apparent from the following specification taken in conjunction with the following drawings.

BRIEF DESCRIPTION OF DRAWINGS

FIG. 5 is a perspective view of a sensor attached to a lever arm according to the invention;

FIG. 6 is a partial sectional view of a rod holder according to an alternate embodiment of the invention;

FIG. 7 is a partial sectional view of the alternate embodiment of the rod holder taken along line 7—7 of FIG. 6; and FIG. 8 is a view of a clip wrapped around a coil spring and a borderwire.

DETAILED DESCRIPTION

Figure 1:
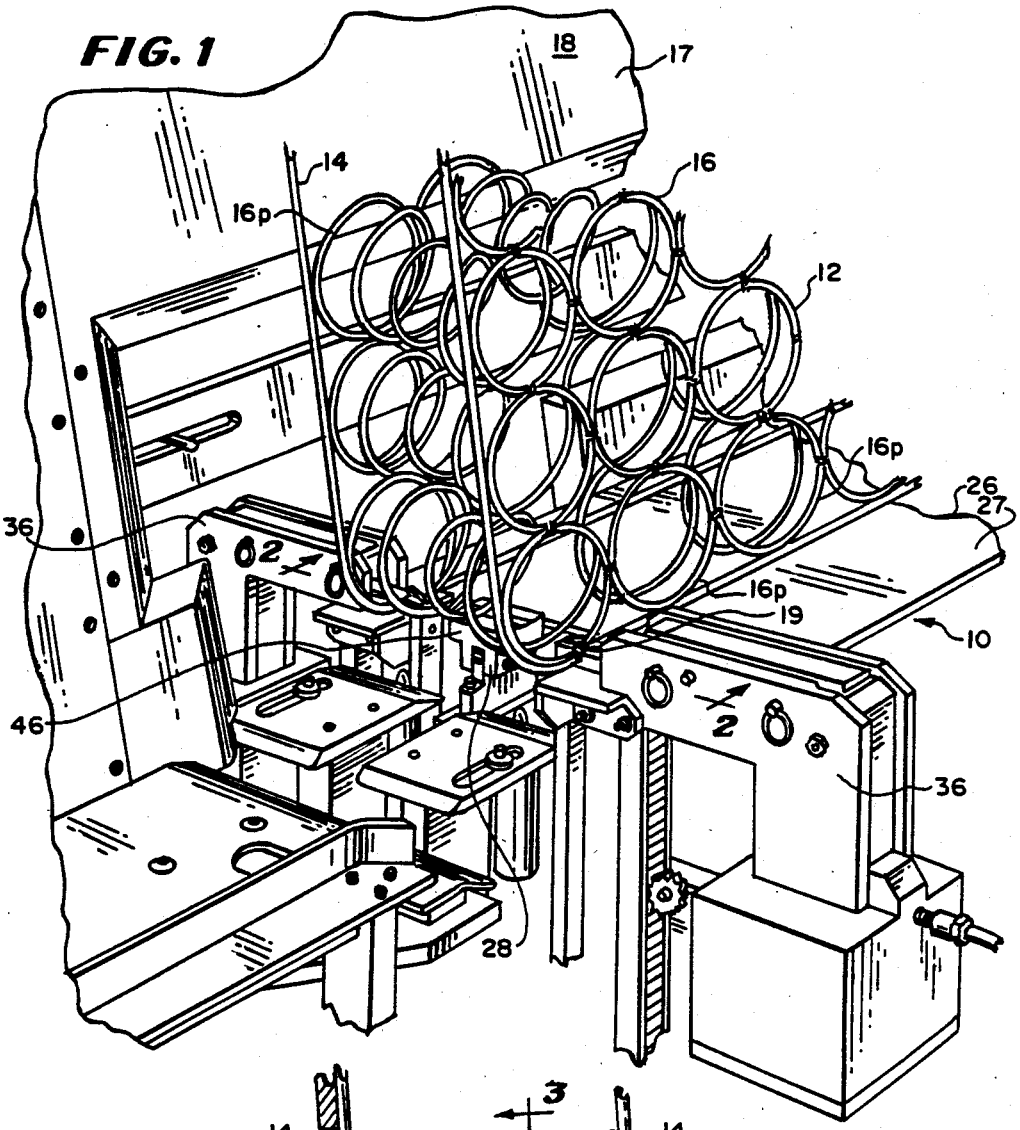
FIG. 1 is a partial perspective view of an apparatus for securing borderwires on a mattress innerspring according to the invention.

While this invention is susceptible of embodiments in many different forms, there is shown in the drawings and will herein be described in detail, preferred embodiments of this invention with the understanding that the present disclosure is to be considered as an exemplification of the principles of this invention and are not intended to limit the broad aspects of the invention to the specific embodiments illustrated.

A device generally designated 10 for automatically securing a mattress innerspring 12 to a pair of spaced borderwires 14 is illustrated in FIG. 1. A more detailed explanation of the operation of the device 10 can be found in the above referenced patent to Ayres, et al., U.S. Pat. No. 4,829,643, the specification of which is expressly incorporated herein by reference.

The innerspring 12 comprises a plurality of coil springs, or coils, 16. The coils 16 which are located along the perimeter of the innerspring 12 are referred to herein as perimeter coils **16*p***.

The device 10 comprises an elongated, generally rectangular shaped frame member 17 which is maintained in a substantially upright position. The frame member 17 is tilted rearwardly at an angle of declination of the order of about 15 degrees to vertical, and is provided with a smooth surface skin or facing 18. The slight inclination of the frame member 17 maintains the center of gravity of the mattress innerspring 12 and its associated borderwires 14 in a position such that the rear one of the borderwires 14 will remain in contact with the facing 18 throughout the clip wrapping operation. The facing 18 provides a snag proof surface along which the mattress innerspring 12 and the borderwires 14 are advanced while clips 19 are being wrapped on the borderwires 14 and the respective portions of the perimeter coils 16*p*. One of the clips 19 wrapped around a coil 16 and a borderwire 14 is illustrated in FIG. 8.

Referring again to FIG. 1, the front of the frame member 17 is provided with an outwardly extending, relatively narrow ledge or platform 26 having an upwardly directed surface 27 on which an edge of the mattress innerspring 12 and borderwires 14 ride as they are advanced toward a clip wrapping station 28. The clip wrapping station 28 includes a pair of clip wrapping tools 36. The clip wrapping tools 36 secure the perimeter coils 16*p* to the borderwires 14, 15 by means of ones of the clips 19. A more detailed explanation of the clip 19 and the clip wrapping tools 36 can be found in patents to Langas, et. al., U.S. Pat. No. 3,641,656 and to Langas, U.S. Pat. No. 4,546,528 as well as commonly assigned U.S. patent application Ser. No. 297,129, the specifications of which are expressly incorporated herein by reference.

In order to accurately attach the perimeter coil 16*p* to the borderwires 14, the device 10 must know when the respective one of the perimeter coils 16*p* is properly aligned between the clip wrapping tools 36. Accordingly, a sensor generally designated 38 is provided at the clip wrapping station 28 to sequentially indicate when each of the perimeter coils 16*p* is properly positioned between the clip wrapping tools 36.

Figure 2:
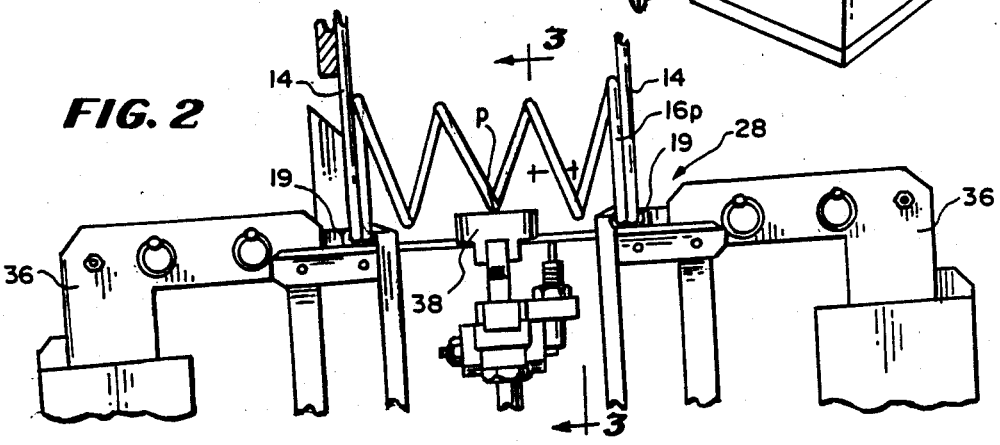
FIG. 2 is an end elevational view of the apparatus of the invention taken along line 2—2 of FIG. 1.

The device 10 is illustrated in FIG. 2 in a view taken along line 2—2 of FIG. 1. The radial dimension of the coils 16, including that of the perimeter coils 16*p*, is smaller near the centers of the coils 16 than at the ends thereof. As indicated above, the sensor 38 is located substantially between the clip wrapping tools 36. The sensor 38 is sequentially activated when contacted by a point P on each of the perimeter coils 16*p*, indicating that the particular coil 16*p* is correctly positioned between the clip wrapping tools 36. In fact, because of a finite amount of time between contact of the point P with the sensor 38 and the actuation of the clip wrapping tools 36, the sensor 38 is placed slightly upstream of the clip wrapping tools 36 to account for the over-travel of the perimeter coil 16*p* during the finite amount of time, as discussed below.

Figures 3, 4:
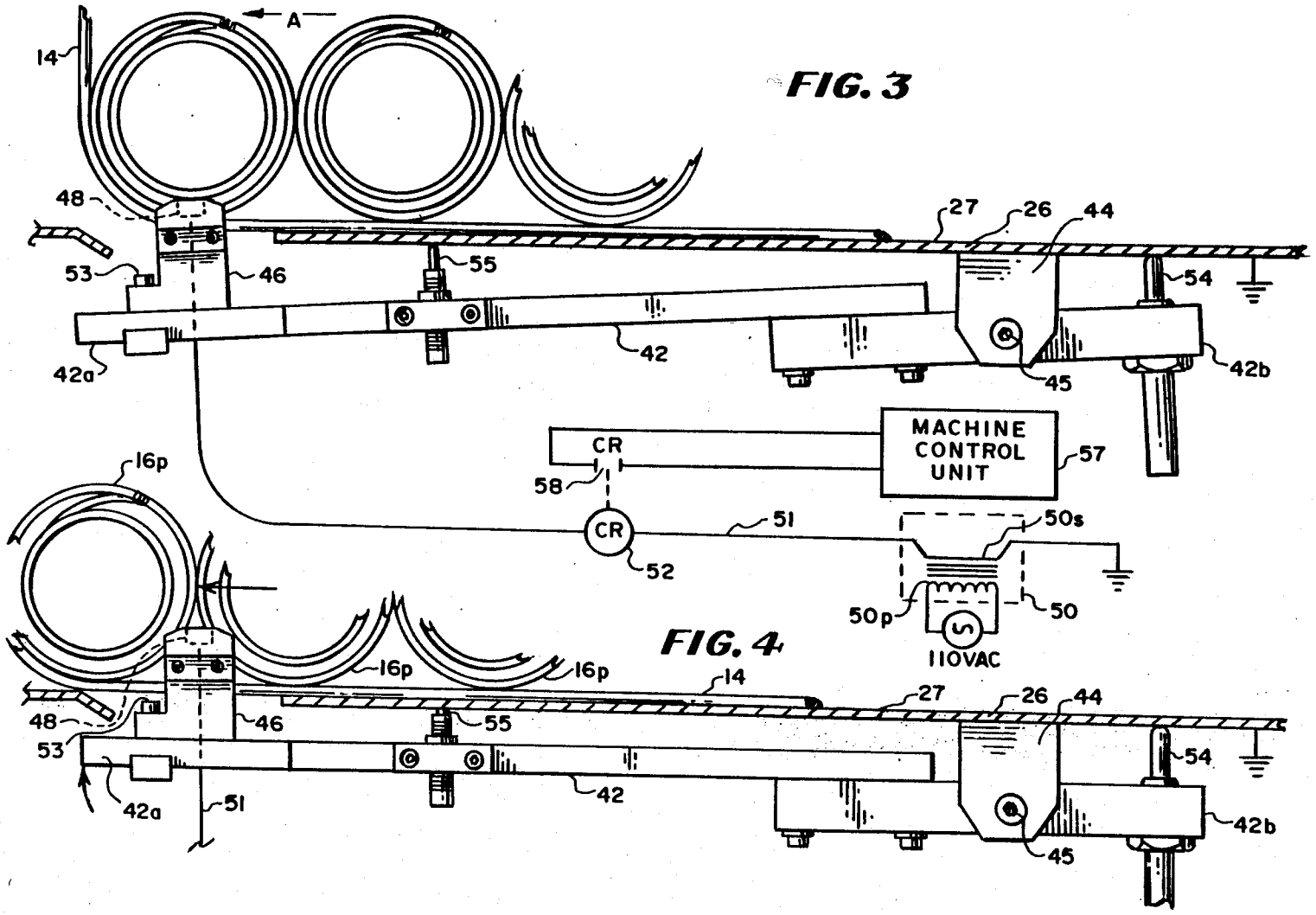
FIG. 3 is a partial side elevational view of the apparatus of the invention taken along line 3—3 of FIG. 2, including a schematic.
FIG. 4 is a partial side elevational view of the apparatus of the invention with the borderwire and innerspring further advanced than shown in FIG. 3.

A first embodiment of the invention is illustrated in FIGS. 3–5. According to the first embodiment, a lever arm 42 has a first end 42*a* and a second, opposite end 42*b*. The lever arm 42 is pivotally attached to a bracket 44 extending downwardly from the ledge 26 by a pivot 45.

An insulated rod holder 46 is upwardly disposed from the first end 42*a* of the lever arm 42 through a slot 47 (FIG. 5). The rod holder 46 includes an electrically conductive, horizontal contact rod 48 mounted transverse to the direction of the lever arm 42.

A transformer 50 having a primary winding 50*p* for coupling to a source of 110 volts AC provides 12 volts AC at its secondary winding 50*s*. One terminal of the secondary winding 50*s* is coupled to ground, and the other terminal of the secondary winding 50*s* is coupled via a conductor 51 to the contact rod 48. A control relay coil 52 is coupled in series with the conductor 51.

An adjusting screw 53 secures the rod holder 46 to the first end 42*a* of the lever arm 42, permitting the rod holder 46 to move within the slot 47 (FIG. 5) toward or away from the clip wrapping tools 36 (FIGS. 1 and 2). The adjusting screw 53 permits the rod holder 46 to be properly positioned to account for the over-travel of the perimeter coil 16*p* during the time between sensing of the coil 16 and actuation of the clip wrapping tool 36.

An adjustable spring loaded plunger 54 is coupled to the second end 42*b* of the lever arm 42, extending upwardly therefrom to contact the underside of the ledge 26. The spring loaded plunger 54 biases the second end 42*b* of the lever arm 42 away from the ledge 26, thereby upwardly biasing the first end 42*a* of the lever arm 42. A cushioned stop adjusting screw 55 opposes the spring loaded plunger 54 and prevents the first end 42*a* of the lever arm 42 from striking the underside of the ledge 26.

As the innerspring 12 is advanced along the surface 27 as indicated by an arrow A, the perimeter coils 16*p* riding along the surface 27 will sequentially contact the contact rod 48, downwardly pivoting the first end 42*a* of the lever arm 42, as illustrated in FIG. 3. The ledge 26 is grounded, which maintains the perimeter coils 16*p* at ground potential. The contact rod 48 is maintained at a potential of less than 24 volts, preferably 12 volts, by the transformer 50. As each of the perimeter coils 16*p* contact the contact rod 48, electrical current flows between the contact rod 48 and the perimeter coils 16*p* to ground, causing current to flow through the control relay coil 52.

A machine control unit 57 includes a control relay 58 responsive to the current flow through the control relay coil 52. When each of the perimeter coils 16*p* makes contact with the contact rod 48, causing current to flow through the control relay coil 52, the control relay 58 momentarily closes, generating a position signal in the machine control unit 57 to actuate the clip wrapping tools 36.

As illustrated in FIG. 4, the spring load plunger 54 returns the rod holder 46, and resultingly the contact rod 48, to their upward position when not contacting the perimeter coils 16*p*. Because the contact rod "floats", contact with each of the perimeter coils 16*p* is effectively insured regardless of the specific diameters of the perimeter coils 16*p*.

A second embodiment of the invention is illustrated in FIGS. 6 and 7. According to the second embodiment, the rod holder 46 is still secured to the first end 42*a* of the lever arm 42 for detection of the perimeter coils 16*p*. However, a proximity switch 60, such as a Model 923FS2-A7TV3, distributed by Microswitch Division of Honeywell Corporation, is disposed in the rod holder 46.

According to the second embodiment, when each of the perimeter coils 16*p* contact the contact rod 48, the contact rod 48 is pushed downward within the rod holder 46 approximately 1/16', opposing the bias of a pair of springs 61. The downward presence of the contact rod 48 is sensed by the proximity sensor 60, which generates a position signal. As with the first embodiment, the machine control unit 57 responds to the position signal to actuate the clip wrapping tools 36, as is well known in the art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A device for automatically securing a borderwire on a mattress innerspring, said mattress innerspring comprising a plurality of coils including perimeter coils located along a perimeter of said innerspring the device comprising:

a tool for sequentially joining segments of said borderwire to said perimeter coils;

means for advancing said mattress innerspring and borderwire toward said tool;

an element for sequentially contacting each of said perimeter coils;

a sensor for detecting contact of said element with said perimeter coils; and means responsive to said detection for actuating said tool.

2. The device of claim 1 including:

means for maintaining said element at a first potential voltage; and means for maintaining said perimeter coils at a second, different potential voltage, wherein said sensor includes means for detecting current passing between said element and said perimeter coils.

3. The device of claim 2 wherein said second potential is substantially ground.

4. The device of claim 3 wherein said first potential is substantially twelve volts.

5. The device of claim 1 wherein said sensor includes:

a proximity switch; and means for biasing said element away from said proximity switch, wherein contact of each of said perimeter coils with said element opposes said biasing means, moving said conductive element toward said proximity switch.

6. A device for automatically securing a borderwire on a mattress innerspring, said mattress innerspring comprising a plurality of coil including perimeter coils located along a perimeter of said innerspring, the device comprising:

a surface;

a clip wrapping tool for sequentially joining segments of said borderwire to said perimeter coils;

means for advancing said mattress innerspring and borderwire along said surface;

a lever arm pivotally joined below said surface and having a first end and a second end;

a sensor extending upwardly from said first end of said lever arm for detecting when each of said perimeter coils is located a distance from said tool, said sensor including a contact rod, and means for detecting sequential contact of said contact rod with and each of said perimeter; and means responsive to said sequential detecting means for sequentially actuating said tool.

7. The device of claim 6 wherein said contact detecting means includes:

means for maintaining said contact rod at a first voltage potential;

means for maintaining said perimeter coils at a second different voltage potential; and means for detecting current flow between said contact rod and said perimeter coils.

8. The device of claim 7 wherein said second potential is substantially ground.

* * * * *